United States Patent [19]

French

[11] Patent Number: 4,516,685

[45] Date of Patent: May 14, 1985

[54] SUPPORTING A CONTAINER WITH RESPECT TO A PLATE

[76] Inventor: Michael J. French, 12, Cedar House, Ancastle Green, Henley on Thames, Oxfordshire, England

[21] Appl. No.: 483,205

[22] Filed: Apr. 13, 1983

Related U.S. Application Data

[63] Continuation of Ser. No. 341,522, Jan. 21, 1982, abandoned.

[30] Foreign Application Priority Data

Feb. 2, 1981 [GB] United Kingdom ..... 8103097

[51] Int. Cl.[3] ..... A47G 19/03; A47G 19/06

[52] U.S. Cl. ..... 220/23.83; D7/27; D7/38; D7/70; 206/563; 206/565

[58] Field of Search ..... 220/23.83, 23.86; D7/27, 38, 19, 70; 248/359; 206/562, 563, 565

[56] References Cited

U.S. PATENT DOCUMENTS

| | | | |
|---|---|---|---|
| D. 227,851 | 7/1973 | Nowland | D7/38 |
| 2,719,414 | 10/1955 | Davis | 220/23.83 |
| 2,916,180 | 12/1959 | Alger | 220/23.86 |
| 3,192,894 | 7/1965 | Staver | 248/359 |
| 3,401,858 | 9/1968 | White | 220/23.86 |
| 3,955,672 | 5/1976 | Brundage | 220/23.86 |

FOREIGN PATENT DOCUMENTS

| | | | |
|---|---|---|---|
| 2158 | of 1890 | United Kingdom | 220/23.83 |
| 1126304 | 9/1968 | United Kingdom . | |

*Primary Examiner*—George E. Lowrance
*Attorney, Agent, or Firm*—Spencer & Frank

[57] ABSTRACT

The present invention provides a plate 1 suitable for supporting food therein or thereon, which comprises a portion defining a recess 4 for receiving a part of a drinking container such that, in use, the container abuts, and is supported by the portion and does not tend to slide out from the recess 4 on tilting of the plate 1 from the horizontal.

7 Claims, 5 Drawing Figures

SUPPORTING A CONTAINER WITH RESPECT TO A PLATE

This application is a continuation of application Ser. No. 341,522, filed Jan. 21, 1982, now abandoned.

BACKGROUND OF THE INVENTION

This invention relates to supporting a container with respect to a plate suitable for supporting food thereon or therein and particularly relates to a plate suitable for supporting a stemmed or waisted drinking container, such as a glass, and to means attachable to a plate, the means being suitable for supporting a container, such as a glass.

It is now common practice, for example at business and social functions, for people to eat whilst standing. It is both difficult and cumbersome to hold both a plate and glass whilst eating or holding a conversation in a crowded room. Normally, it is not possible to place the glass on the plate because of the presence of food and, even if this were possible, spillages of the contents of the glass could readily occur.

SUMMARY OF THE INVENTION

It is an object of the present invention to provide means for supporting a drinking container, such as a glass, with respect to a plate.

According to a first aspect of the present invention there is provided a plate suitable for supporting food thereon or therein, which comprises a portion defining a recess or aperture for receiving a part of a container suitable for holding a beverage therein such that, in use, the container abuts, and is supported by, the portion and does not tend to slide out from the recess or aperture on tilting of the plate from the horizontal.

According to a second aspect of the present invention there is provided means attachable to a plate suitable for supporting food thereon or therein, which means defines a recess or aperture for receiving a part of a container suitable for holding a beverage therein, such that, in use, the container abuts, and is supported by, the said means and does not tend to slide out from the recess or aperture on tilting of the plate from the horizontal.

According to a third aspect of the present invention there is provided a plate suitable for supporting food thereon or therein, which comprises a portion defining a peripheral recess for receiving part of a stemmed or waisted container suitable for holding a beverage therein, such that the container abuts, and is supported by, an upper surface of the portion.

According to a fourth aspect of the present invention there is provided a plate suitable for supporting food thereon or therein, which comprises a portion lying in a different plane from a food supporting part of the plate, which portion defines a peripheral recess for receiving part of a stemmed or waisted container such that, in use, the container abuts, and is supported by, the portion.

Advantageously, the portion comprises at least part of the width of the rim of the plate, the rim preferably sloping inwardly towards the centre of the plate.

In a further embodiment, at least that portion of the plate against which the drinking container abuts, in use, comprises a collar.

Although a peripheral recess can, if required, extend to the base, that is the food receiving portion of the plate, it is preferred that the recess does not encroach on the base. Means, such as a ridge, may be provided at the inner end of the recess to keep food from entering the recess or contacting the container. In the embodiment comprising the collar, the collar itself can act as such means.

The recess can be of any suitable shape. For example, it can be of "U" configuration or for example, the recess may have a narrow inlet or neck portion and an enlarged, for example bulbous, main portion.

This invention is suitable for plates of various materials, such as china, plastics material and "paper" plates normally comprising paper or cardboard material, and for plates of various shapes such as circular and oval. With respect to "paper" plates the embodiment including the collar is particularly advantageous because the collar can be used to provide strengthening.

BRIEF DESCRIPTION OF THE DRAWINGS

For a better understanding of this invention, reference will now be made, by way of example, to the accompanying drawings, in which.

DESCRIPTION OF THE PREFERRED EMBODIMENT

Figure 1:
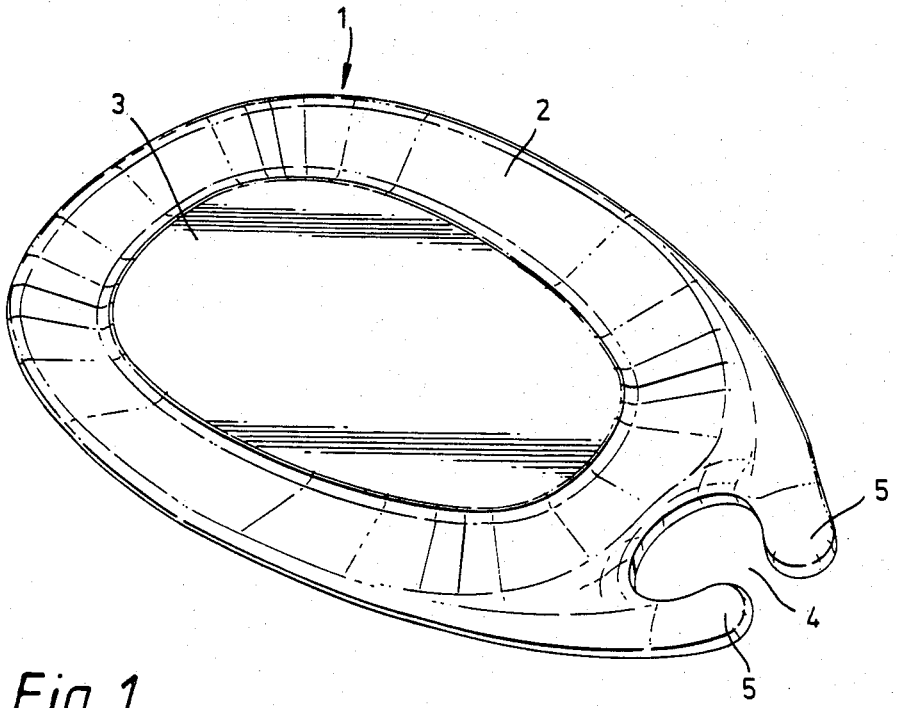
FIG. 1 shows a perspective view of a preferred embodiment of the present invention from above.
Figures 2, 2A, 2B, 3:
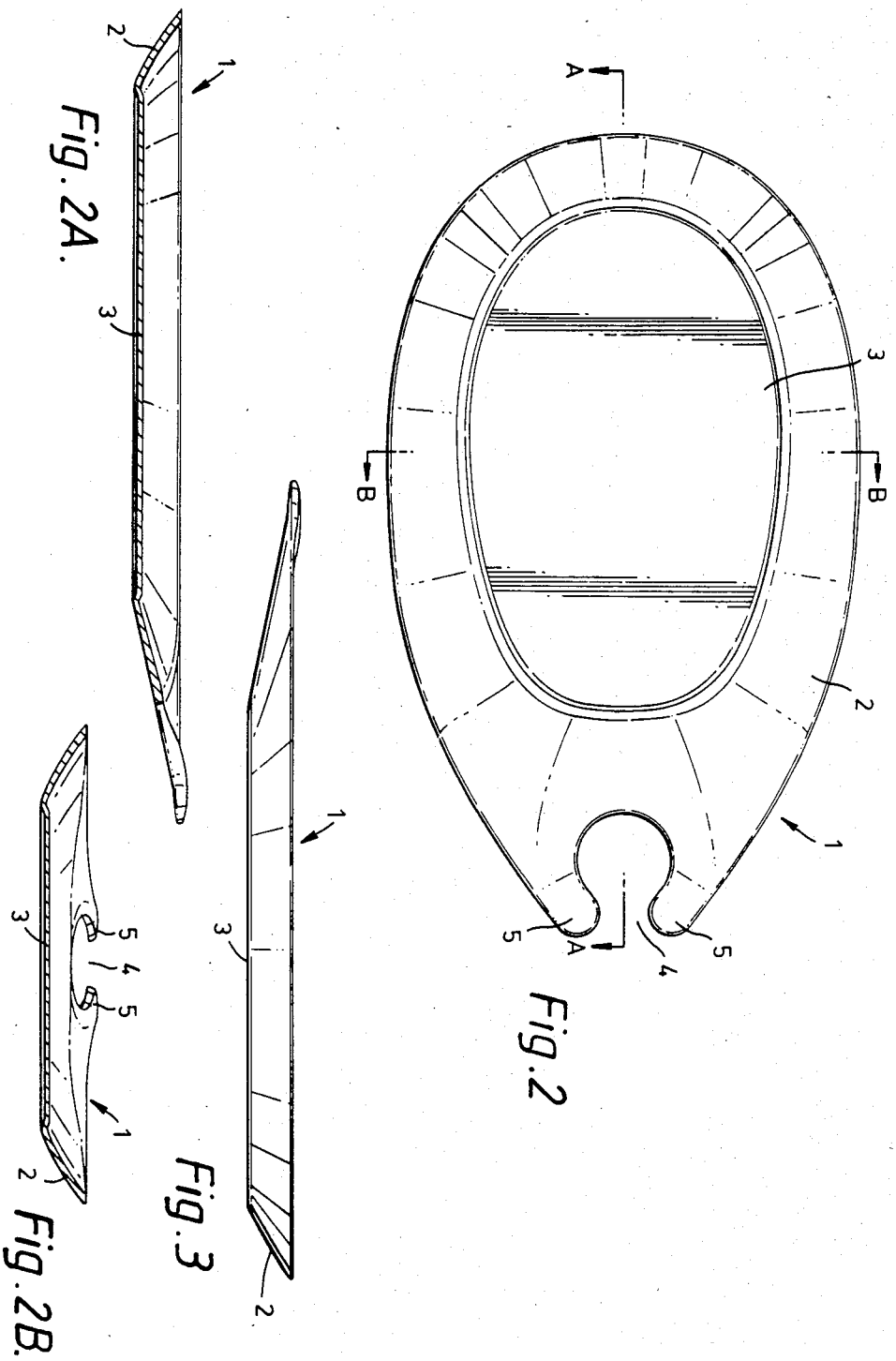
FIG. 2 shows a perspective view of the plate of FIG. 1 from beneath.
FIG. 2A shows a sectional view taken along the line A—A of FIG. 2.
FIG. 2B shows a sectional view taken along the line B—B of FIG. 2.
FIG. 3 shows a view of the plate of FIG. 1 from one side.

There is shown a plate 1, which may be made of china, plastics material or cardboard, having a rim 2 and a base portion 3. The rim 2 is provided with a peripheral recess 4, which is substantially circular with a narrow neck portion, and slopes upwardly relative to the base portion 3.

In use, the stem of a stemmed glass can be positioned in the recess 4 so that the body of the glass abuts and is supported by that part of the rim 2 in the region of the recess 4. Because the rim 2 slopes upwardly relative to the base portion 3, the glass does not tend to slide out from the recess, and food supported by the base portion 3 does not tend to fall through the recess, when the plate is tilted from the horizontal.

It is envisaged that, in an alternative embodiment of the invention, the portions 5 might be joined to form an aperture in the plate.

In a further embodiment of the invention, the recess could comprise an indentation in the plate.

I claim:

1. A plate for supporting food and a container provided with a stem or waist connected to a bowl portion, said plate comprising:

a first portion having an upper surface for supporting the food and a lower surface, said lower surface constituting the lowest level of said plate when said plate is in the horizontal position; and a rim connected to said first portion and forming the periphery of said plate, said rim including a second portion provided with an aperture and defining a slot through the periphery of said rim which joins said aperture, said slot being shaped for passing the stem or waist of the container through the periphery of said plate into said aperture, said second portion sloping upwardly away from said first portion to stably support the bowl portion of the container, so that the container does not tend to slide out from the aperture through the slot when the plate is tilted from the horizontal.

2. A plate according to claim 1 wherein the said second portion is formed in a different plane from said food supporting surface of the plate.

3. A plate according to claim 1 wherein a ridge is provided between said aperture and said food supporting surface of the plate.

4. A plate according to claim 1 wherein said second portion forms a collar for supporting the container.

5. A plate according to claim 1 which comprises a ceramic material.

6. A plate according to claim 1 which comprises a plastics material.

7. A plate according to claim 1 which comprises cardboard.

* * * * *